United States Patent [19]

Harrel

[11] Patent Number: 4,620,802

[45] Date of Patent: Nov. 4, 1986

[54] GUIDE FOR ROTATING SUCKER RODS

[75] Inventor: Robert D. Harrel, Tulsa, Okla.

[73] Assignee: Tellin, Incorporated, Tulsa, Okla.

[21] Appl. No.: 764,135

[22] Filed: Aug. 9, 1985

[51] Int. Cl.[4] ..... F16C 29/04; E21B 17/10

[52] U.S. Cl. ..... 384/53; 175/325

[58] Field of Search ..... 308/6 A, 4 A; 175/325, 175/406; 166/241, 173, 117.5

[56] References Cited

U.S. PATENT DOCUMENTS

| | | | |
|---|---|---|---|
| 2,198,720 | 4/1940 | Edgecomb et al. | 308/6 A |
| 3,907,048 | 9/1975 | Gray | 175/325 |
| 4,253,531 | 3/1981 | Boros | 175/325 X |

FOREIGN PATENT DOCUMENTS

| | | | |
|---|---|---|---|
| 2081346 | 2/1982 | United Kingdom | 175/325 |

*Primary Examiner*—Stuart S. Levy

*Assistant Examiner*—Thomas R. Hannon

*Attorney, Agent, or Firm*—Head, Johnson & Stevenson

[57] ABSTRACT

A guide for use in a string of sucker rods rotated in tubing in a borehole, each guide being formed of an elongated, upright, cylindrical coupling body having female threads at the upper and lower ends for attachment in a string of sucker rods, and including a plurality of at least three recesses in the body cylindrical surfaces, there being a recess in at least each 120° quadrant around the body, an axle received in each recess, the axis of each axle being parallel and spaced from the body longitudinal axis, and a roller rotatably received on each axle, the periphery of each roller extending exteriorly of the external cylindrical surface of the coupling body, the rollers being conical shaped on each end, and the roller serving to contact the interior wall of tubing in which the sucker rod string is rotated to prevent wear of the tubing and the sucker rod string.

4 Claims, 5 Drawing Figures

GUIDE FOR ROTATING SUCKER RODS

SUMMARY OF THE INVENTION

Oil wells have historically been pumped by sucker rods reciprocated in a string of tubing. A pumping unit at the earth's surface functions to reciprocate the rods and a positive displacement bottom hole pump is moved up and down by the sucker rods to move fluid up the interior of the tubing to the earth's surface. While this concept has worked satisfactorily for many years, it has been somewhat replaced in recent years by the use of rotating pumping systems. It has been learned that rotating pumping systems can be installed generally at a reduced cost and that the efficiency of operation is better than reciprocated rod systems.

When a long sucker rod string is rotated in a tubing there is a tendency for the sucker rods to wear against the interior wall of the tubing. If all wells were perfectly vertical and therefore all tubing strings perfectly straight the wear problem would not be serious. However, a perfectly straight well is a rarity and for this reason most wells have tubing strings which are not straight but are curved at different points in their length. In addition, if the sucker rods utilized to rotate a bottom hole pump could be placed under significant tension in a straight well the propensity of the sucker rods to rotate against the tubing wall would be reduced. However, most bottom hole pumps of the type which are rotated are not adaptable to resist a large amount of upper pull. Therefore, it is difficult to place the sucker rod strings in tension and therefore there is a tendency for the sucker rods to rotate against the walls of the tubing.

When a sucker rod contacts the wall of tubing string three bad things happen. First, there is wear on the sucker rod which substantially reduces its useful life. Second, there is wear on the interior of the tubing and if the wear is continuously concentrated at one point, a hole can be worn in the tubing and when this happens the tubing leaks fluid from the interior back into the annulus reducing the efficiency of the pumping system. If the hole is large enough it becomes impossible to pump fluid to the top, requiring the tubing string to be replaced. Third, energy is lost by the frictional contact of the sucker rods with the tubing.

For all of these reasons it is highly advantageous to provide a means of preventing rubbing contact between a rotating sucker rod and the interior of tubing and the present invention is directed towards solving this problem. Therefore, the present invention is a guide for rotating sucker rods. The guide includes an elongated upright cylindrical coupling body which is of external diameter less than the internal diameter of the tubing in which it is used. The coupling body has internally threaded openings at each end to receive the male threads of upper and lower sucker rods so that the guide body can be inserted in a sucker rod string. The threaded openings are coaxial with the body cylindrical axis.

Formed in the exterior cylindrical surface of the coupling body are a plurality of at least three recesses. The recesses are oriented relative to each other so that there is a recess in at least each 120° quadrant around the body.

Positioned in each recess is an axle. The axis of each axle is parallel and spaced from the body longitudinal axis.

A roller is received on each axle. The periphery of each roller extends exteriorly of the external cylindrical surface of the coupling body. The distance measured from the coupling body longitudinal axis to the point on each roller cylindrical surface most distant from the body axis is less than the radius of the internal cylindrical surface of the tubing in which the guide is dimensioned to operate. Stated another way, the imaginery cylindrical surface generated by rotation of the coupling body about its axis is less than the internal diameter of the tubing.

Each roller is preferably formed of a truncated conical portion at each end. This has several advantages, the main one of which is it greatly facilitates placing the sucker rod string in and removing it from a well.

Each roller is preferably made of a material softer than the material of the tubing. Since tubing is customarily made of steel, rollers may be made of aluminum bronze which resists acids in produced crude oils, is long wearing, and is softer than the steel tubing so that it will not cut the tubing. Obviously other materials may be used which meet the criteria of being long wearing, acid resistant and being softer than the steel of which tubing is made.

Guides are placed in a rod string according to the conditions of each oil well in which they are used. In the typical application they may be placed between every other length of sucker rod; that is, since sucker rods are typically of about 25 feet in length, a rod guide of the type described and illustrated herein may be placed at every 50 feet in rod string. If the oil well is highly deviated, that is, crooked, a rod guide may be required between every length of sucker rod; that is, every 25 feet. Rod guides may be required all the way from the top to the bottom of the hole if it is crooked throughout, or if the hole is otherwise straight except for a deviated area, the sucker rod guides can be placed only in the area of deviation. An operator experienced in using a string of sucker rods in a rotating pumping well can readily determine from an examination of the rods after the rod string has been used for a period of time which locations require the use of a rod guide of the type disclosed in this invention. The rod guide of this invention replaces the typical sucker rod coupling.

DETAILED DESCRIPTION OF THE PREFERRED EMBODIMENT

Figure 1:
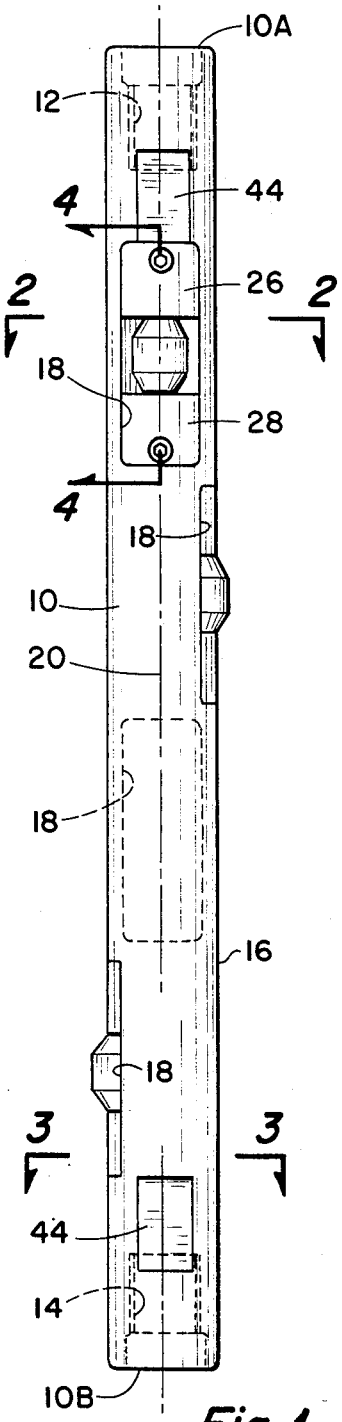
FIG. 1 is an elevational external view of a rod guide employing principles of this invention.

Referring to the drawings first to FIG. 1, a preferred embodiment of the invention is illustrated it being understood that the invention can be practiced utilizing devices which may have a completely different appearance than that illustrated but which nevertheless employ the principles of the invention. An elongated upright cylindrical coupling body 10, which will typically be formed of high grade tool steel or the like, has an upper end 10A and a lower end 10B. Within upper end 10A is an internally threaded recess 12 which, when the coupling member is placed in a sucker rod string, receives the lower externally threaded male end of a sucker rod (not shown). In like manner, within the lower end 10B is an internally threaded recess 14 which receives the externally threaded male end of a downwardly extending sucker rod (not shown). In this way the coupling body 10 is mounted in the length of a sucker rod string and functions in the manner of a typical sucker rod coupling, except that it is normally, in the preferred embodiment, somewhat longer.

Figure 2:
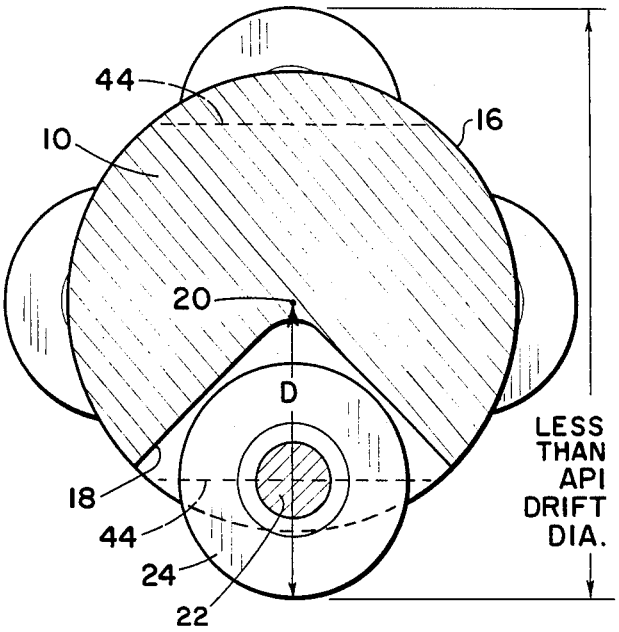
FIG. 2 is a cross-sectional view taken along the lines 2—2 of FIG. 1.

Formed in the cylindrical surface 16 of the coupling body is a plurality of recesses 18. By plurality it is meant three or more. The illustrated embodiment of the invention employs four recesses 18 oriented 90° apart rotationally around the longitudinal axis 20 of the coupling body. When three recesses 18 are employed they should be spaced 120° apart rotationally. When four are employed they are spaced 90° apart as shown in FIG. 2. Obviously a number greater than four can be employed and arranged rotationly so that there is at least one recess in each 120° segment around the coupling body.

Recesses 18 may be of various configurations. A preferred configuration is illustrated and is achieved by the recess having a generally V-shape cross-sectional configuration as shown in FIG. 2 with the side walls of the recess intersecting each other at about a 90° angle. Obviously the recess 18 could be U-shaped in cross-section or of other shape.

Figure 3:
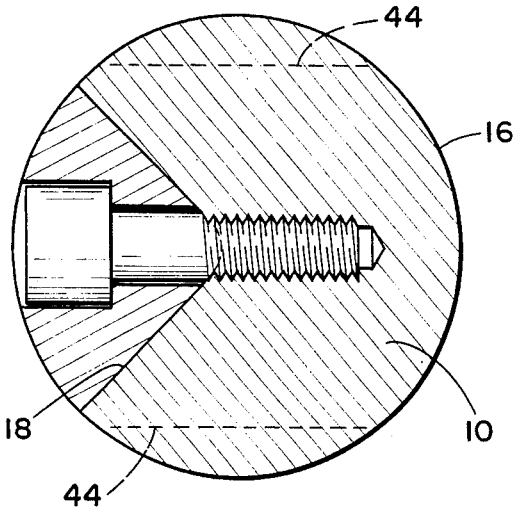
FIG. 3 is a cross-sectional view taken along the lines 3—3 of FIG. 1.
Figure 4:
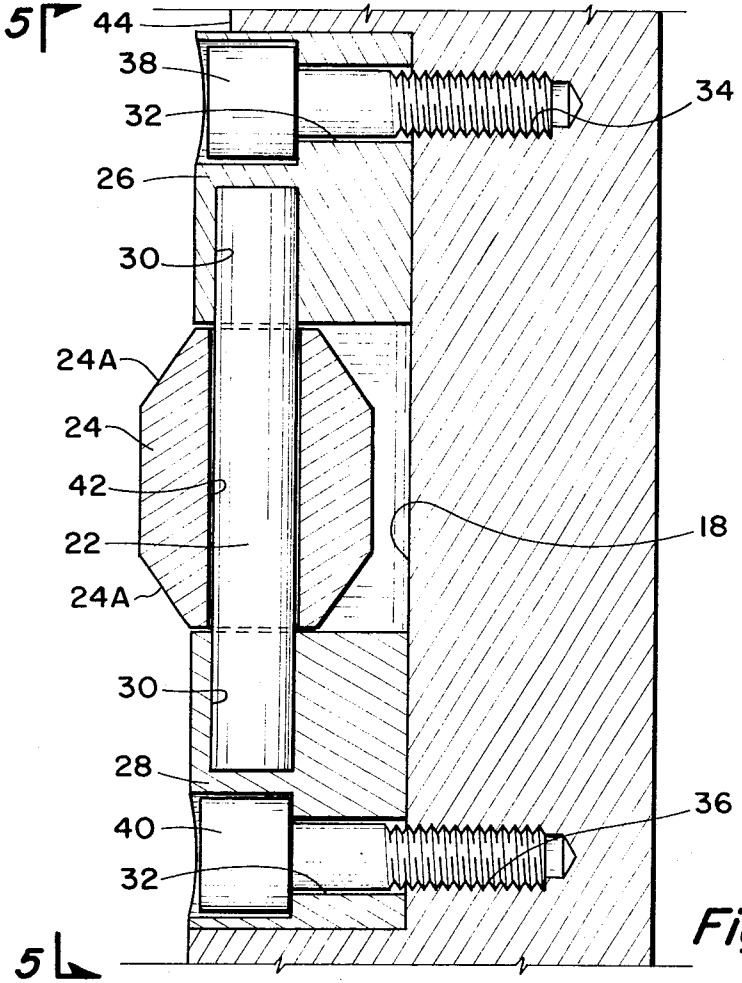
FIG. 4 is a cross-sectional view taken along the lines 4—4 of FIG. 1; that is, along the axis of an axle supporting a roller.
Figure 5:
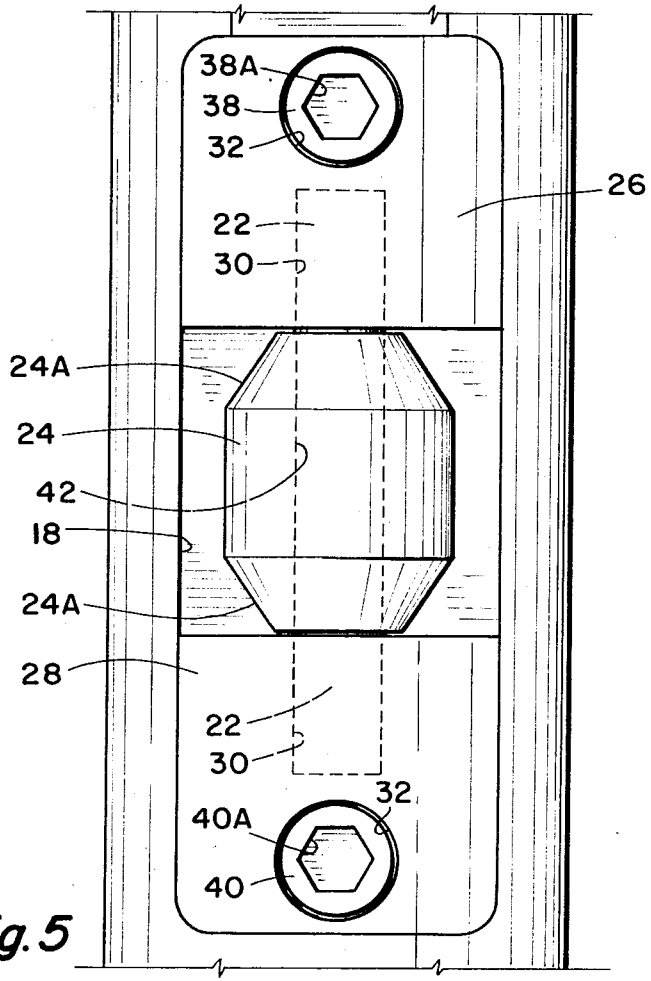
FIG. 5 is an enlarged fragmentary view as seen along the lines 5—5 of FIG. 4 showing more details of the construction of the roller and the holder portions of the invention.

Received in each recess is an axle 22 supporting a roller 24, as seen best in FIGS. 3, 4 and 5. While the axle 22 may be supported within the recess in a variety of ways the illustrated manner employs a pair of axle holders, designated as an upper axle holder 26 and a lower axle holder 28. Each of the axle holders 26 and 28 are configured alike and are provided with external surfaces to match the cross-sectional configuration of the recess 18 in which they are positioned. The length of each of the holders 26 and 28 is less than one-half of the length of a recess 18 leaving a space between them, which space receives roller 24. Each of the upper and lower axle holders 26 and 28 has a recess 30 therein which receive the ends of axle 22. While the axles can be supported in holders in a variety of ways a preferred method is that the recesses 30 are dimensioned so that the axle 22 is press-fitted into the recesses. The assembly steps are that the roller 24 is placed on axle 22 and the end pieces 26 and 28 are pressed in place on the axle. This assembly is then positioned within a recess 18.

Each holder 26, 28 also has a bolt opening 32 in it. The axis of bolt openings 32 is perpendicular the axis of the axle receiving recesses 30. The axis of the axle receiving recesses 30, when the holders are in position, are parallel to the longitudinal axis 20 of body 10 whereas the axis of each bolt receiving opening 32 is perpendicular the coupling body longitudinal axis 20.

Formed in the coupling body in the area of each recess is an upper internally threaded opening 34 and a lower internally threaded opening 36 which are in alignment with the bolt openings 32 in the upper and lower holders. An upper bolt 38 and a lower bolt 40 are received in openings 32 of the holders 26, 28 to maintain the holders in position by the threaded engagement of the bolts with upper and lower internally threaded openings 34 and 36. The bolt openings 32 are configured so that the head of bolt 38 and 40 are completely received within the openings and engage an internal shoulder in each opening to retain the holders in position. As shown in FIG. 5, bolts 38 and 40 include an internal hexagonal recess 38A and 40A respectively so that by means of an allen wrench the bolt may be threaded into position to retain the holders in recesses 18 or, when the bolts are unthreaded, permit the holders to be removed.

Each roller 24 has an axle opening 42 therethrough rotatably receiving an axle 22 so that the rollers are freely rotatable about the axles and are held in position between the upper and lower holders 26, 28. The peripheral configuration of each roller 24 may vary but the preferred arrangement is as shown wherein each roller has a central cylindrical portion with an integral truncated conical portion 24A at each end. This arrangement provides a major advantage in permitting a sucker rod string, with the rod guides of this invention included, to be lowered into and pulled out of a string of tubing, the truncated portions 24A serving to freely pass over obtruding surfaces in the interior of a tubing string. Another advantage of the configuration as illustrated, having conical portions 24A at each end, is that as the roller 24 wears the cylindrical portion is extended in length, increasing the area of contact with the tubing. Thus, if wear takes place on the interior of a tubing string because of the constant rolling of a roller against the interior wall of the tubing at one location, as the roller wears the area of contact increases, thus reducing the concentration of wear in a single area. In the preferred arrangement as illustrated, the conical portions 24A reduce to a minimum diameter at the ends of the roller which is less than the cylindrical diameter of the coupling body so that the ends of the rollers are not exposed to engage any obtruding surfaces within the tubing string.

Each roller 24 is preferably made of a material which resists the chemical action of crude oil, that is, material which resists acidic action. The material of which the roller 24 is made must be long wearing but at the same time is preferably softer than the tubing so that if wear takes place it will be in a roller and not in the tubing wall since it is much easier and less expensive to replace rollers than replace tubing. For this reason a typical material of which the roller 24 may be formed is aluminum bronze, although obviously a variety of other metallic and non-metallic materials may be used which meets the criterias set out herein.

As shown in FIG. 2, the distance D from the coupling body longitudinal axis 20 to the point on the periphery of each roller 24 most distance from the axis 20, indicated by the letter D, must be less than the radius of the internal cylindrical surface of the tubing in which the coupling body is employed. This is a way of saying that the maximum dimensions of the coupling, including rollers 24, must be less than the interior of the tubing so that the coupling will freely longitudinally pass into and out of the tubing string and allow free rotation within the tubing string.

As seen in FIGS. 1, 2 and 3, wrench flats 44 are formed on the exterior of body 10 adjacent the upper and lower ends 10A and 10B, the wrench flats being on opposed sides of the body and providing means whereby a wrench may be used to either rotate the body or hold it against rotation so that it is easily threaded onto or removed from an adjacent sucker rod.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An improved guide for use in a string of sucker rods rotated in a tubing string in a borehole, the sucker rods having threaded male ends, the guide comprising:

an elongated upright solid cylindrical coupling body of external diameter less than the internal diameter of tubing in which it is to be used, the coupling body having sucker rod receiving female threaded openings at the upper and lower ends, the threaded openings being coaxial of the body cylindrical axis whereby the body may be positioned in a string of sucker rods, and including a plurality of at least three recesses in the body cylindrical surface, the recesses being oriented relative to each other so that there is a recess in at least each 120° quadrant around the body, each recess being elongated and having opposed planar walls each in a plane parallel the coupling body cylindrical axis and the planes intersecting to form a notch of V-shaped configuration in planes prependicular the coupling body cylindrical axis;

a pair of spaced apart axle holders positioned in each said recess, each pair of holders having aligned axle receiving recesses therein, each holder being defined in part by two planar intersecting surfaces, the planar surfaces of each holder being matingly received by said planar walls of the said recess receiving the holder, and being further defined by a semicircular surface of radius equal said cylindrical coupling body whereby each holder completes the external circumferential surface of the cylindrical coupling body in planes perpendicular the coupling body cylindrical axis passing through each holder;

an axle received in each said recess in said coupling body, the axis of each axle being parallel and spaced from the body longitudinal axis;

a roller rotatably received on each axle, the periphery of each roller extending exteriorly of the external cylindrical surface of said coupling body a distance measured from the coupling body cylindrical axis to a point on each roller cylindrical surface most distant from the body axis being less than the radius of the internal cylindrical surface of the tubing in which the guide is dimensioned to operate, and wherein each said roller has an external surface which is defined relative to the roller rotational axis by a central portion and a frustoconical portion on each end whereby the diameter of the roller adjacent the ends is reduced; and means to retain each of said holders in said coupling body recess.

2. An improved guide according to claim 1 wherein said recesses are elevationally displaced from each other.

3. An improved guide according to claim 1 wherein each said holder has an opening therein, the axis of which is perpendicular to said axile receiving recess and spaced from it, and wherein said body has threaded openings therein in register with said holder openings, and a bolt threadably received in each said holder opening by which the holder is retained within a said body recess.

4. An improved guide according to claim 1 wherein the circumferential surface of each roller at each end thereof is of a diameter such that the ends are recessed below the cylindrical surface of said coupling body.

* * * * *